US006833794B2

(12) United States Patent
Liao

(10) Patent No.: US 6,833,794 B2
(45) Date of Patent: Dec. 21, 2004

(54) POWER-SAVING CLAMPING DEVICE HAVING A LOSS-GUARD FUNCTION

(76) Inventor: Sheng Hsin Liao, No. 10, Alley 38, Lane 229, San Chun St., Shulin City, Taipei Hsien (TW)

( * ) Notice: Subject to any disclaimer, the term of this patent is extended or adjusted under 35 U.S.C. 154(b) by 135 days.

(21) Appl. No.: 10/384,609

(22) Filed: Mar. 11, 2003

(65) Prior Publication Data

US 2004/0178919 A1 Sep. 16, 2004

(51) Int. Cl.[7] ..... G08B 21/00

(52) U.S. Cl. ..... 340/686.6; 340/693.1; 340/686.4; 455/575.1; 455/575.6

(58) Field of Search ..... 340/686.6, 686.4, 340/686.5, 693.2, 693.1; 455/575.6, 575.1, 90.1

(56) References Cited

U.S. PATENT DOCUMENTS 5,610,979 A * 3/1997 Yu ..... 379/455
5,787,168 A * 7/1998 Lien ..... 379/455
5,918,189 A * 6/1999 Kivela ..... 455/575.1
6,341,218 B1 * 1/2002 Poplawsky et al. ..... 455/569.1

* cited by examiner

*Primary Examiner*—Jeffery Hofsass
*Assistant Examiner*—Daniel Previl
(74) *Attorney, Agent, or Firm*—Rosenberg, Klein & Lee

(57) ABSTRACT

A power-saving clamping device having a loss-guard function has a shell body, a circuit unit and a connection component. The circuit unit is disposed in the shell body to receive signals emitted by an emission component. The circuit unit has an alarm component and a contact switch. The connection component is connected to a portable electronic device. The connection component is also connected to the shell body in a detachable way. The portable electronic device can be clamped onto a user's waistband. When the portable electronic device is separated from the circuit unit by a certain distance, the circuit unit immediately emits light or sounds and alarm, thereby preventing the portable electronic device from being lost or stolen by thieves. When the portable electronic device is connected to the clamping device, the contact switch is touched to turn off the electric unit, hence avoiding waste of electric power.

13 Claims, 19 Drawing Sheets

POWER-SAVING CLAMPING DEVICE HAVING A LOSS-GUARD FUNCTION

BACKGROUND OF THE INVENTION

1. Field of the Invention

The present invention relates to a power-saving clamping device having a loss-guard function and, more particularly, to a clamping device, which can be clamped on a user's waistband to facilitate carrying of a portable electronic device, can effectively prevent the portable electronic device from being lost, and can also turn off a circuit unit to avoid waste of electric power when not in use.

2. Background of the Invention

Along with the continual progress of information technology, portable electronic devices like mobile phones, personal digital assistants (PDAs), and electronic communications products have become articles frequently used in everyday lives of most people. Generally, a portable electronic device can be clamped onto a user's waistband by means of a sheath to facilitate carrying. However, this method of carrying a portable electronic device easily gives rise to a situation where the portable electronic device is lost or stolen by thieves.

SUMMARY OF THE INVENTION

The primary object of the present invention is to provide a power-saving clamping device having a loss-guard function, whereby a portable electronic device can be clamped onto a user's waistband. When the portable electronic device separated from a circuit unit of the clamping device by a certain distance, the circuit unit is immediately driven to sound an alarm or display a warning light, hence effectively preventing the portable electronic device from being lost or stolen by thieves. Moreover, when the portable electronic device is connected to the clamping device, it touches a contact switch to turn off the circuit unit, hence avoiding waste of electric power.

To achieve the above object, the present invention provides a power-saving clamping device having a loss-guard function, which can be connected to a portable electronic device. The clamping device comprises a shell body, a circuit unit, and a connection component. The shell body has a clamping sheet disposed on the outer wall thereof. The circuit unit is disposed in the shell body, and can receive signals emitted by an emission component. The circuit unit has an alarm component and a contact switch. The connection component is connected to the portable electronic device. The connection component is also connected to the shell body in detachable way. The emission component is disposed on the portable electronic device or the connection component. When the connection component is connected to the shell body, it touches the contact switch to turn off the circuit unit.

BRIEF DESCRIPTION OF THE DRAWINGS

The various objects and advantages of the present invention will be more readily understood from the following detailed description when read in conjunction with the appended drawing, in which.

DETAILED DESCRIPTION OF THE EMBODIMENTS

Figure 1:
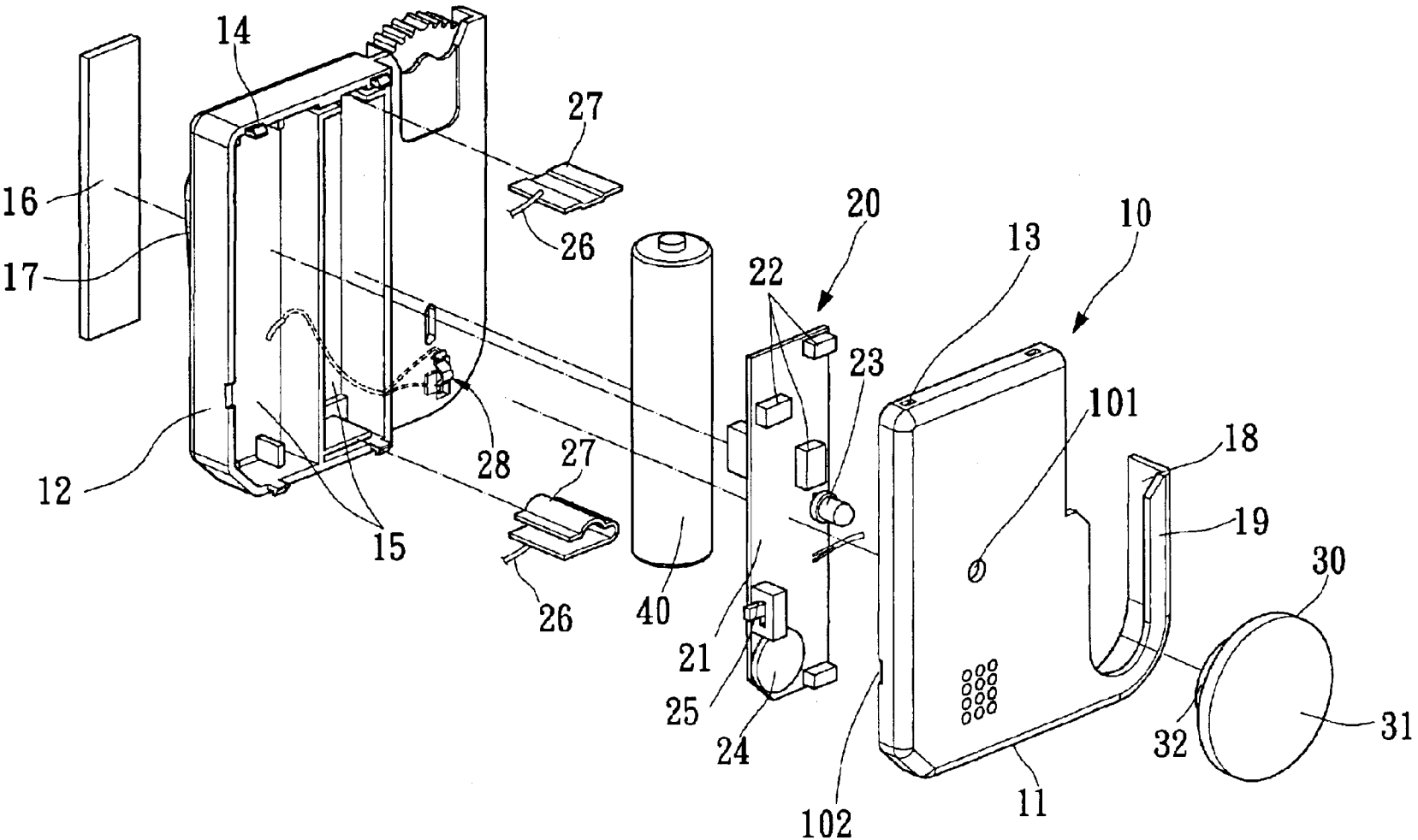
FIG. 1 is an exploded perspective view of a first embodiment of the present invention.
Figure 2:
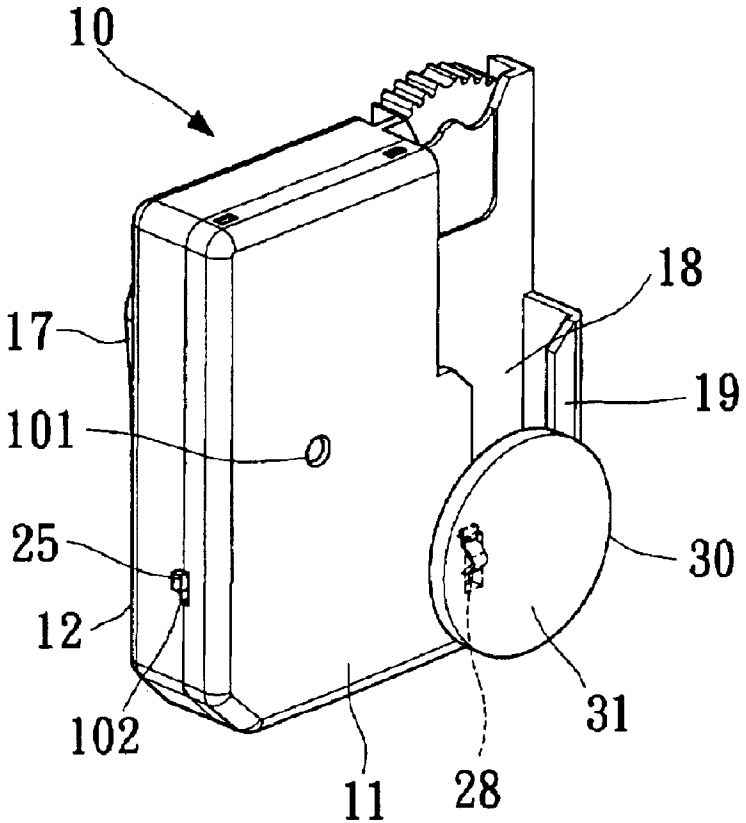
FIG. 2 is a perspective assembly view of the first embodiment of the present invention.
Figure 3:
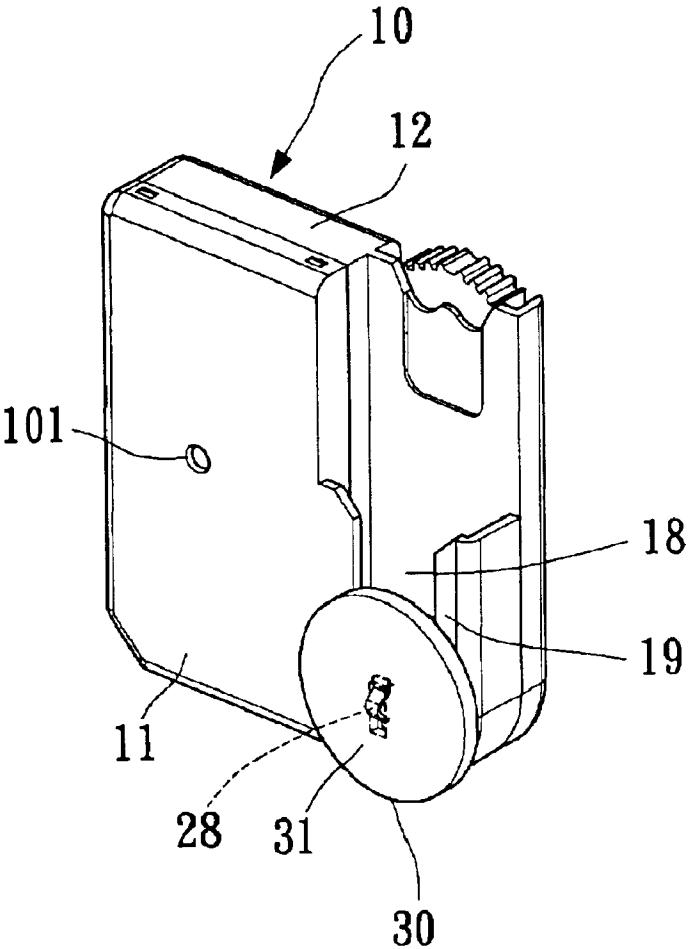
FIG. 3 is another perspective assembly view of the first embodiment of the present invention.
Figure 4:
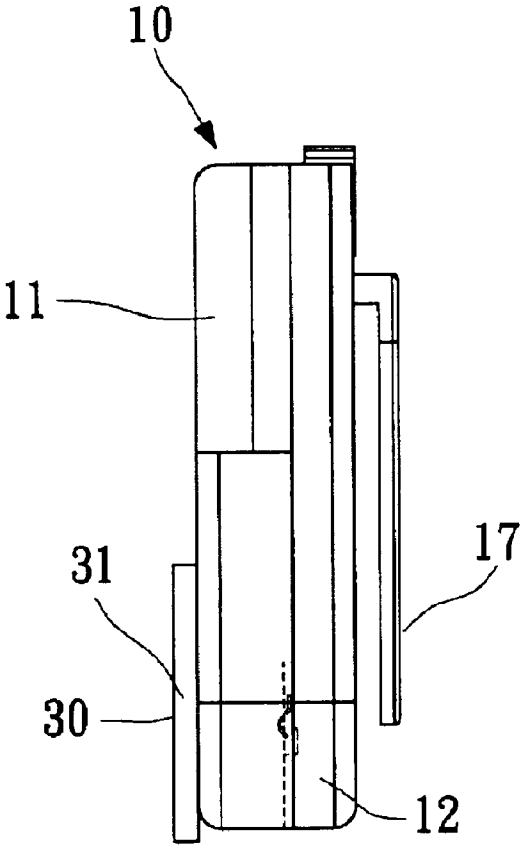
FIG. 4 is a side view of the first embodiment of the present invention.
Figure 5:
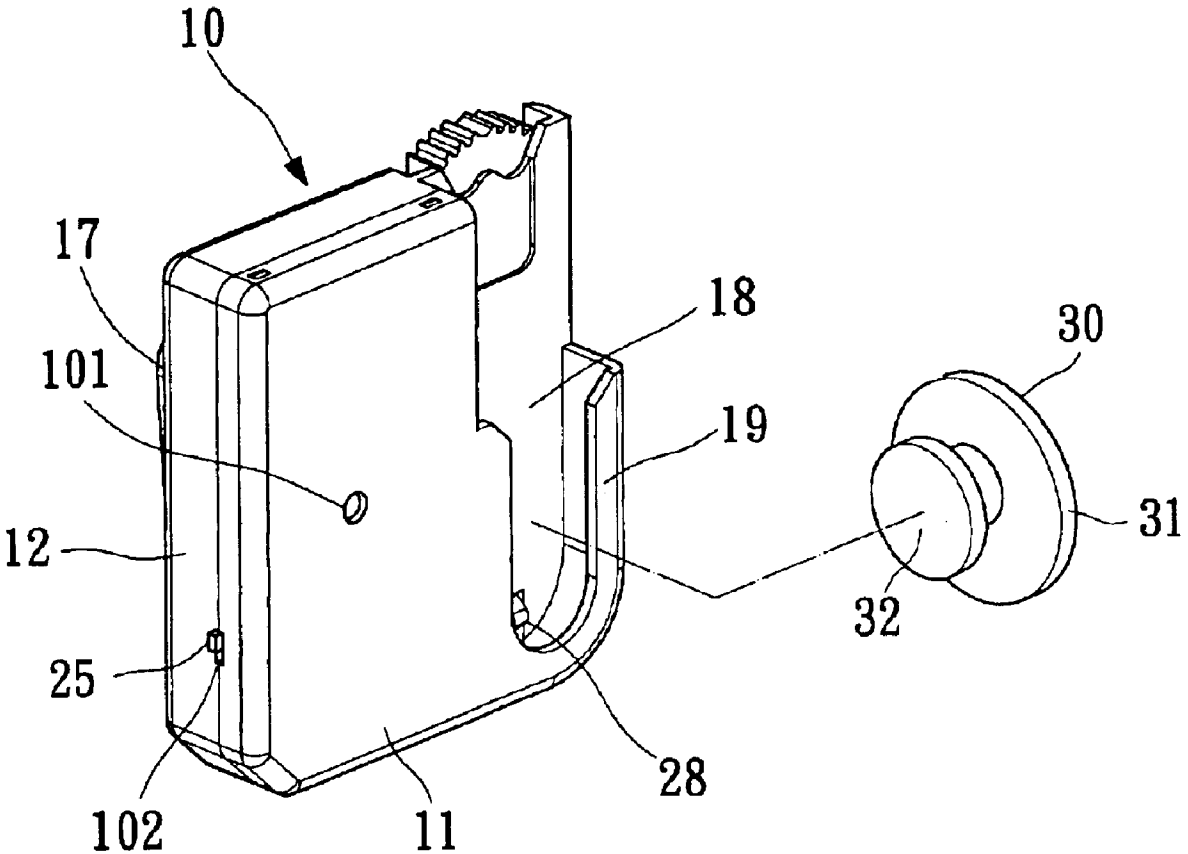
FIG. 5 is a perspective assembly view showing a separate state of the connection component of the first embodiment of the present invention.

As shown in FIGS. 1 to 5, the present invention provides a power-saving clamping device having a loss-guard function. The clamping device comprises a shell body 10, a circuit unit 20, and a connection component 30. The shell body 10 is composed of a first half shell 11 and a second half shell 12, which are assembled together by means of fastening, locking with screws, or supersonic welding. In this embodiment, the first half shell 11 and the second half shell 12 are assembled together by means of fastening. In particular, corresponding fastening holes 13 and fastening hooks 14 are disposed on the first half shell 11 and the second half shell 12. Through mutual fastening of the fastening holes 13 and the fastening hooks 14, the first half shell 11 and the second half shell 12 are assembled together.

The shell body 10 has a receiving space 15 therein for receiving components like the circuit unit 20 and a battery 40. A battery cover 16 corresponding to the battery 40 is fastened on the rear of the shell body 10. The battery cover 16 can be detached to facilitate replacement of the battery 40. A clamping sheet 17 is disposed on the outer wall of the rear of the shell body 10, and can be used to clamp the clamping device of the present invention onto a user's waistband. A fastening groove 18 is disposed in the front side of the shell body 10. The fastening groove 18 is a U-shaped groove body having an open upper end. A baffle 19 is extended from the front side of the fastening groove 18.

Figure 6:
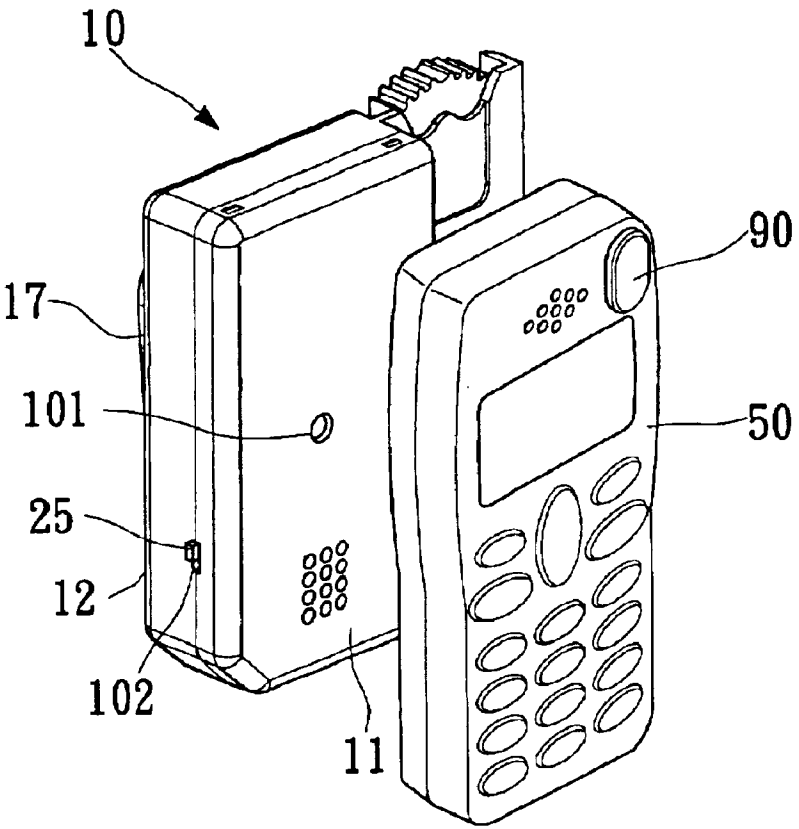
FIG. 6 is a diagram showing the the first embodiment of the present invention in use.
Figure 9:
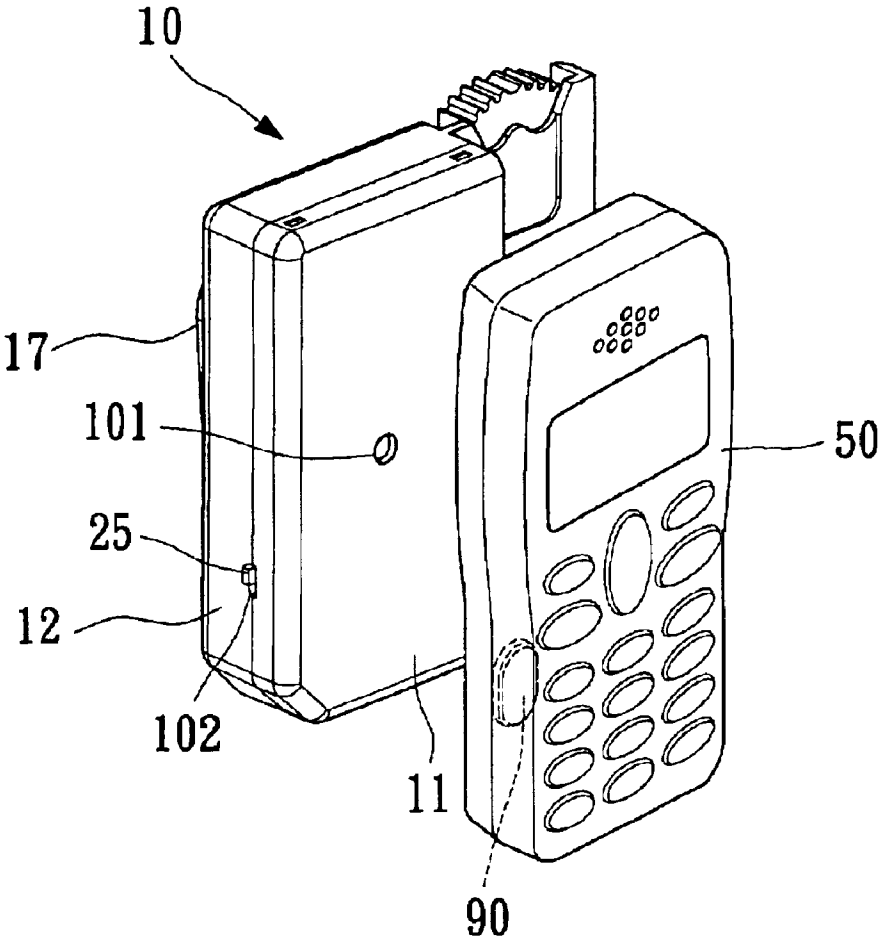
FIG. 9 is still yet another diagram showing the first embodiment of the present invention in use.

The circuit unit 20 is composed of a circuit board 21 and several electronic components 22. The circuit unit 20 is disposed in the receiving space 15. The electronic components 22 have the function of a reception component, and can be used to receive signals emitted by an emission component 90 (shown in FIGS. 6 and 9) preset on a portable electronic device. The emission component 90 can be fixed on the outside of a portable electronic device like a mobile phone 50 by adhering with glue (FIG. 6), or can be fixedly built in a portable electronic device such as a mobile phone 50 (FIG. 9).

The circuit board 21 has an alarm component (e.g., a light-emitting component 23 or a sounding component 24) and a switch 25. The light-emitting component 23 is a device like a light-emitting diode (LED). The sounding component 24 is a device like a buzzer. The switch 25 can be used to switch or turn off the circuit unit 20 according to necessity in manual way. The circuit board 21 is also electrically connected to a contact switch 28, which is exposed by the shell body 10 and sticks into the fastening groove 18. A light-permeable hole 101 corresponding to the light-emitting component 23 and a switch hole 102 corresponding to the switch 25 are disposed on the shell body 10 to allow proper exposure of the light-emitting component 23 and the switch 25.

The circuit board 21 is connected to two conducting sheets 27 with conducting wires 26. The two conducting sheets 27 are properly fastened in the receiving space 15 of the shell body 10, and can respectively contact two poles of the battery 40. The battery 40 and the circuit unit 20 can thus be properly connected so that the electricity of the battery 40 can be transferred to the circuit unit 20.

Figure 7:
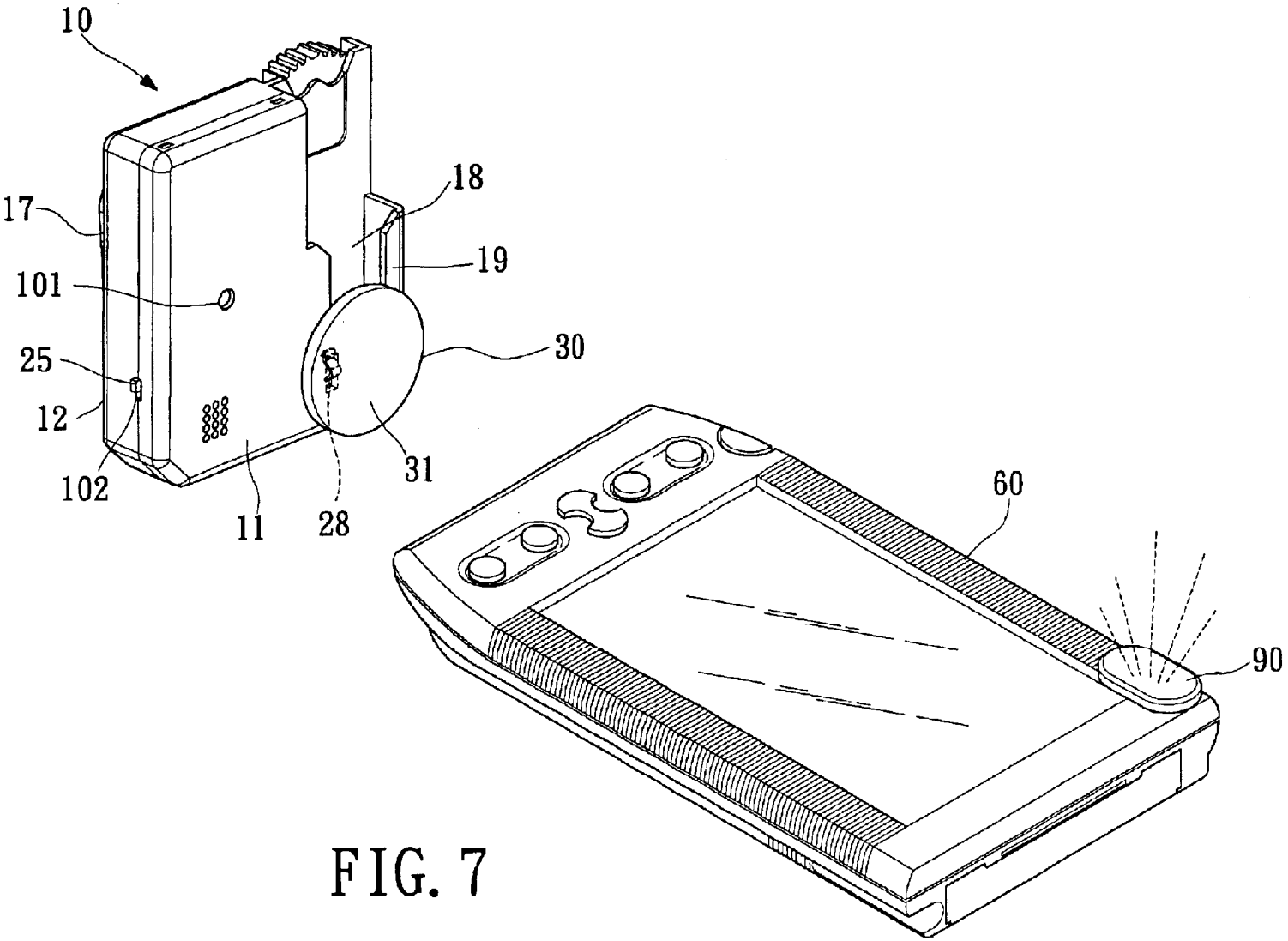
FIG. 7 is another diagram showing the first embodiment of the present invention in use.
Figure 8:
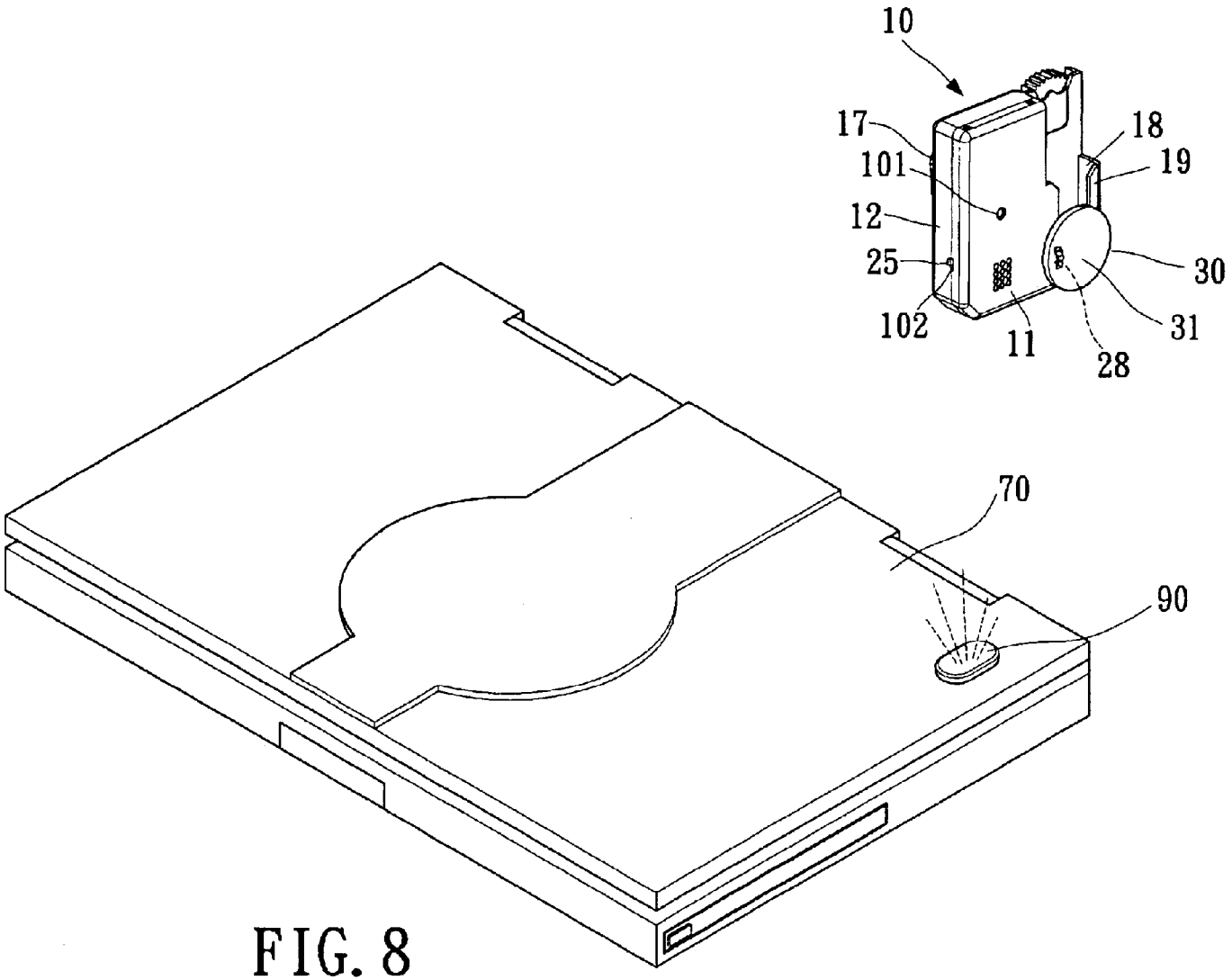
FIG. 8 is yet another diagram showing the first embodiment of the present invention in use.

The connection component 30 has a connection portion 31 and a fastening portion 32. One face of the connection portion 31 can be connected to a portable electronic device like the mobile phone 50 (FIG. 6), a personal digital assistant 60 (FIG. 7), or another electronic communications product 70 (FIG. 8) by adhering with glue so that the connection component 30 can be fixed on the portable electronic device. The fastening portion 32 extends from the other face of the connection portion 31. The fastening portion 32 is a T-shaped post body, and is fastened with the fastening groove 18 of the shell body 10 in detachable way. The baffle 19 on the front side of the fastening groove 18 is used to prevent the fastening portion 32 from moving forwards out of the fastening grove 18. Thereby, the connection portion 30 can connect the portable electronic device onto the shell body 10. When the portable electronic device is fastened with the fastening groove 18 of the shell body 10 with the fastening portion 32 of the connection component 30, the connection component 30 touches the contact switch 28 to turn off the circuit unit 20. The power-saving clamping device having a loss-guard function of the present invention is thus formed.

The emission component 90 preset on a portable electronic device like the mobile phone 50 (FIGS. 6 and 9), the personal digital assistant (PDA) 60 (FIG. 7), or the electronic communications product 70 (FIG. 8) can emit signals, which are received by the circuit unit 20 of the clamping device. However, when the portable electronic device is separated from the circuit unit 20 of the clamping device by a certain distance, the circuit unit 20 can no longer receive signals emitted by the emission component 90 on the portable electronic device. The alarm component, such as the light-emitting component 23 or the sounding component 24, immediately emits light or sound, thereby effectively preventing the portable electronic device from being lost or stolen by thieves.

When the portable electronic device is connected to the fastening groove 18 of the shell body 10 of the clamping device by the fastening portion 32 of the connection component 30, the connection component 30 touches the contact switch 28 to turn off the circuit unit 20, hence avoiding unnecessary waste of electric power.

Figure 10:
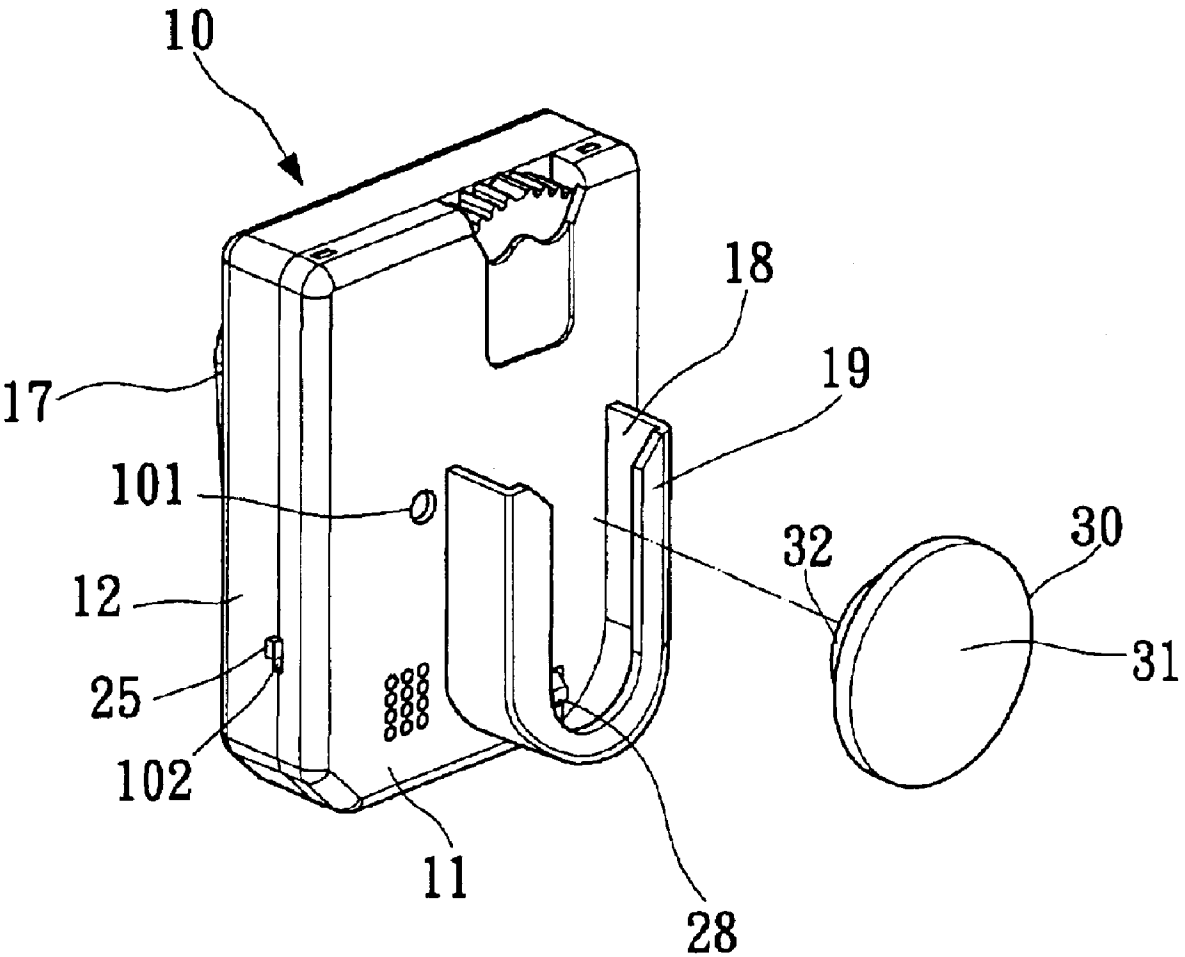
FIG. 10 is a perspective assembly view of a second embodiment of the present invention.

As shown in FIG. 10, it is also feasible that the fastening groove 18 and the baffle 19 of the present invention protrude from of the front side of the shell body 10.

Figure 11:
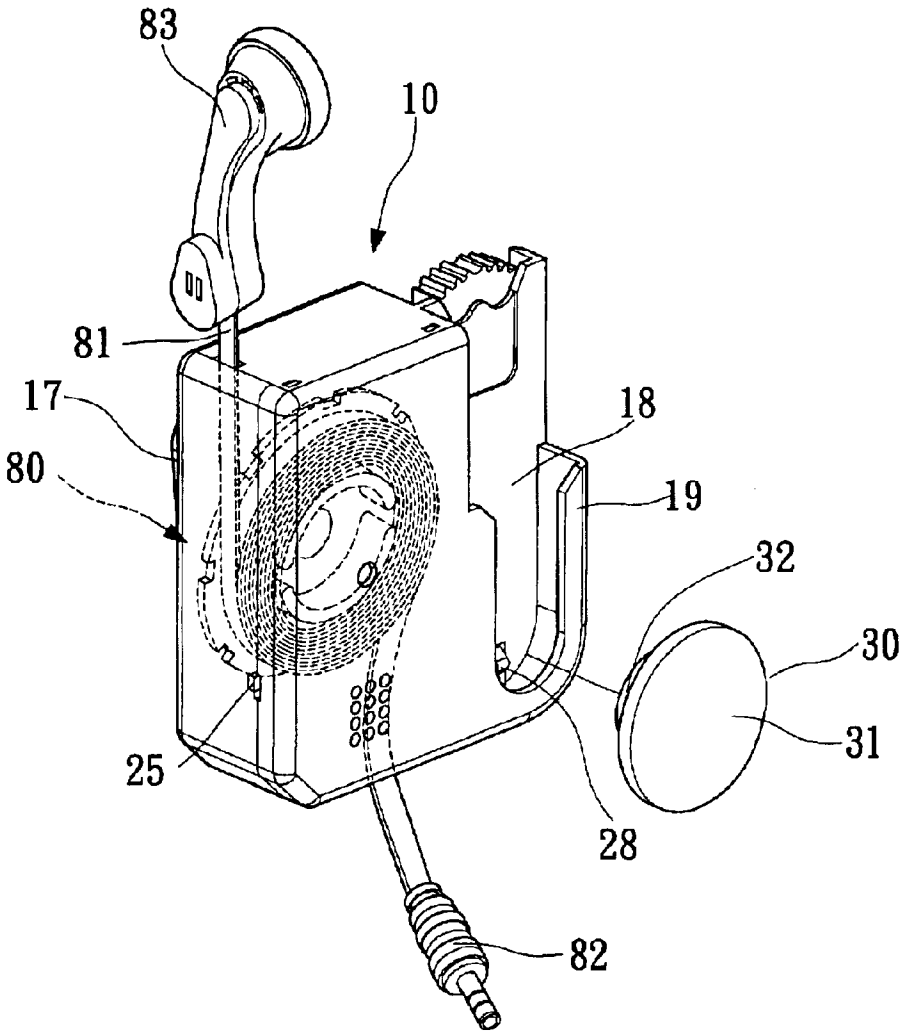
FIG. 11 is a perspective assembly view of a third embodiment of the present invention.

Additionally, as shown in FIG. 11, a wire-winding unit 80 can also be disposed in the shell body 10 so that a signal cable 81 can be selectively wound into the shell body 10 or pulled out of the shell body 10. The length of the signal cable 81 can be momentarily adjusted according to necessity so that entanglement of cable due to an excessive length of external cable or inconvenience of use due to a too-short length of external cable will not arise. Moreover, the two ends of the signal cable 81 can connect to a plug 82 and an earphone 83 or a hand-free headset, respectively. The plug 82 can be plugged into the portable electronic device so that the earphone 83 can be used to hear sound given out by the portable electronic device, or the hand-free headset can be used to transmit or receive voice.

Figure 12:
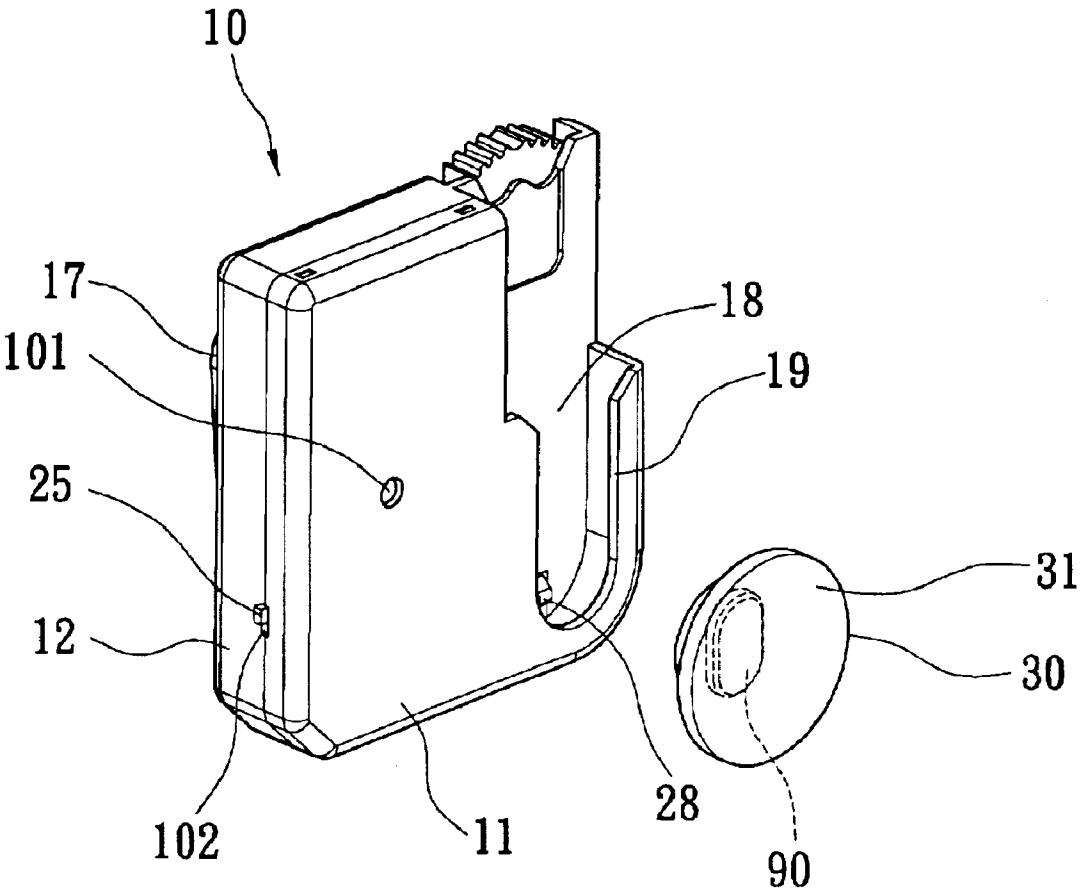
FIG. 12 is a perspective assembly view of a fourth embodiment of the present invention.

Also, as shown in FIG. 12, it is also feasible that the emission component 90 is installed in the connection component 30.

Figure 13:
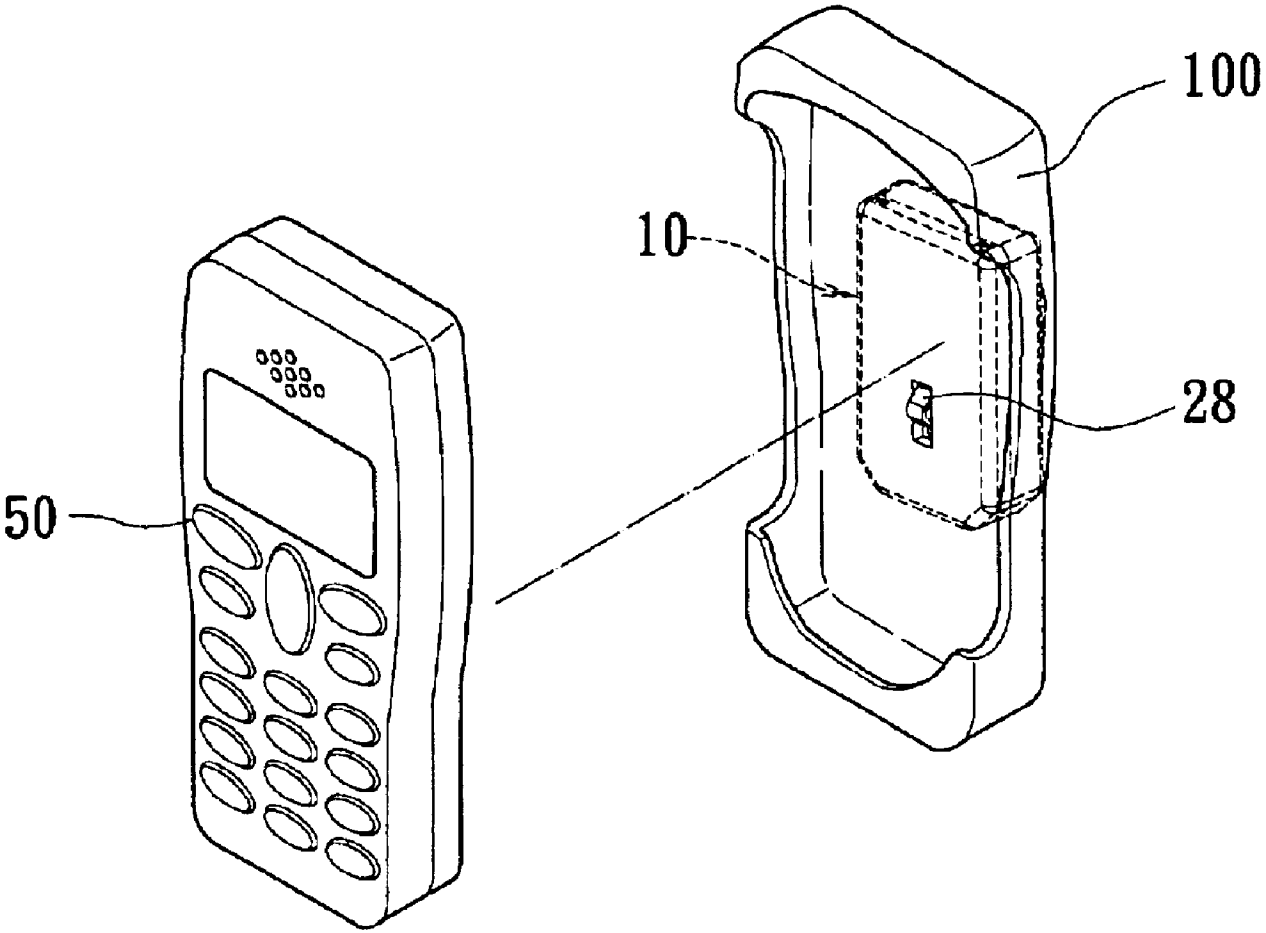
FIG. 13 is a perspective view showing a fifth embodiment of the present invention in use.
Figure 14:
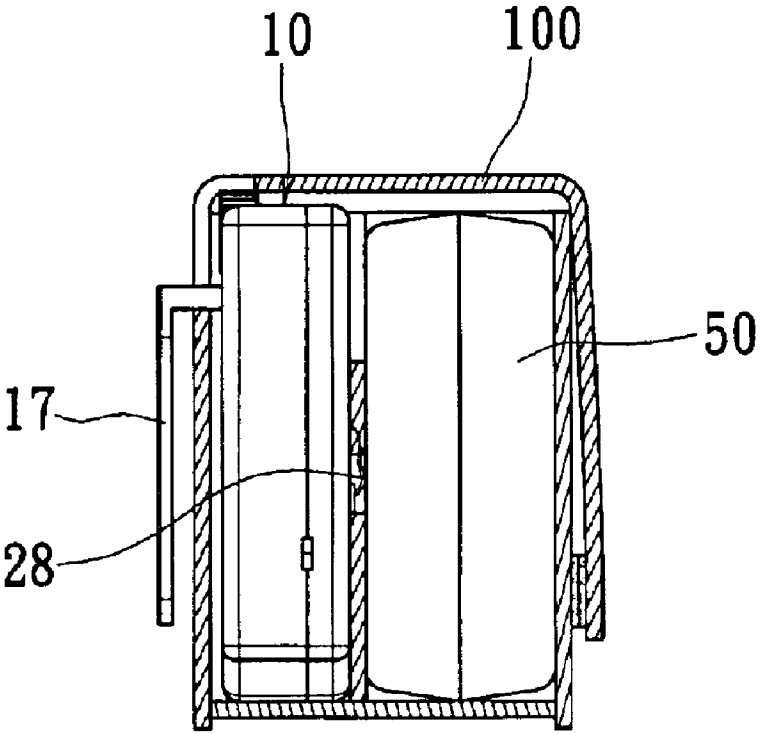
FIG. 14 is a diagram showing a sixth embodiment of the present invention in use.
Figure 15:
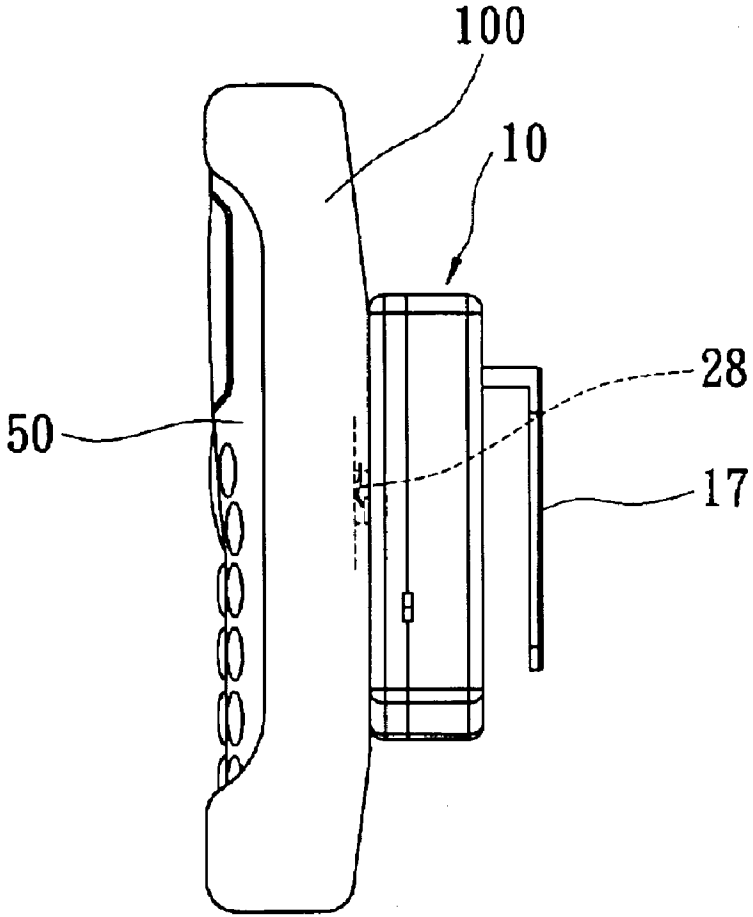
FIG. 15 is a top view showing the fifth embodiment of the present invention in use.

Moreover, as shown in FIGS. 13, 15 and 14, the clamping device can be disposed outside (FIGS. 13 and 15) or inside a sheath body 100 (FIG. 14). The sheath body 100 is a device used to receive the mobile phone 50.

Figure 16:
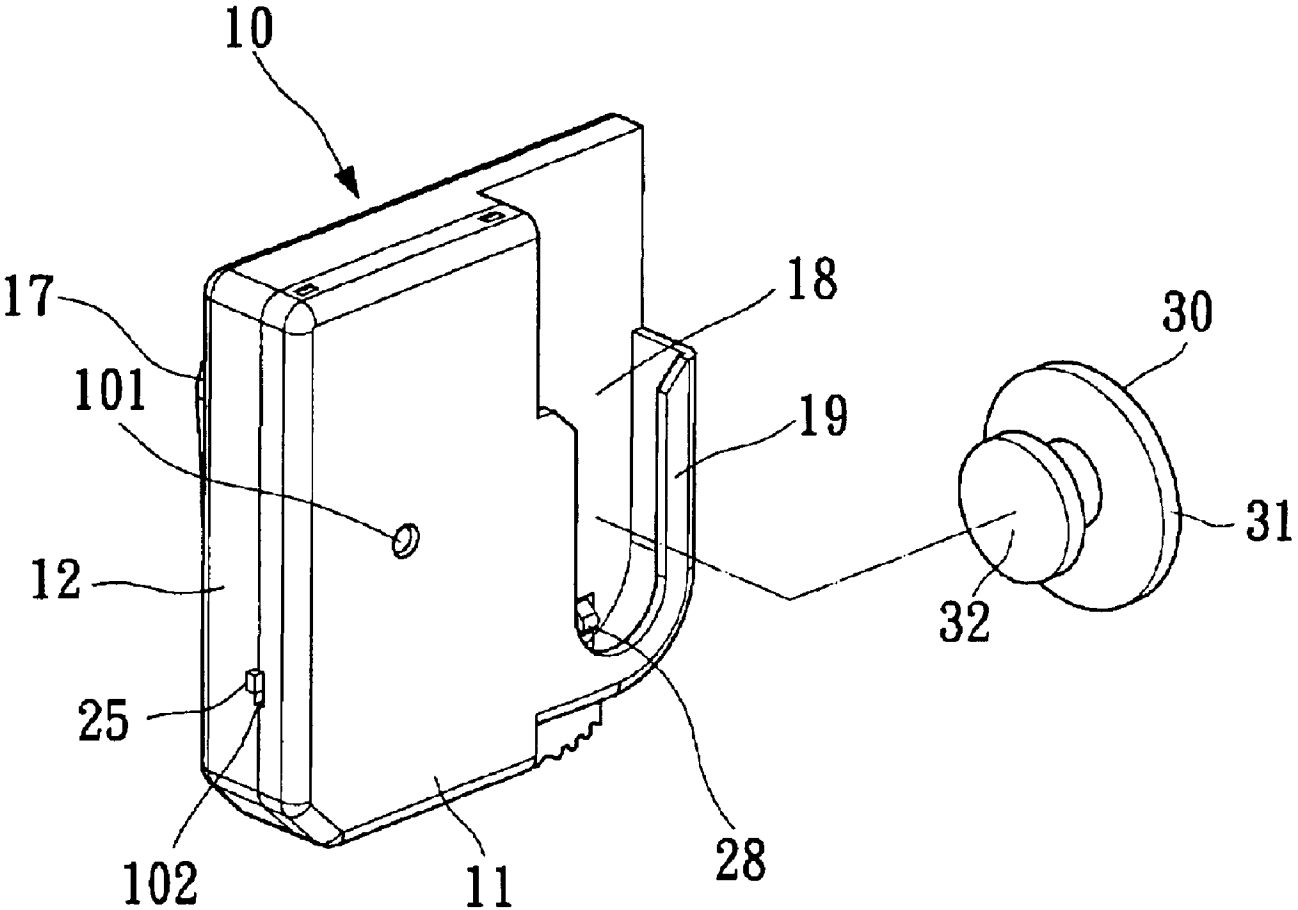
FIG. 16 is a perspective assembly view of a seventh embodiment of the present invention.
Figure 17:
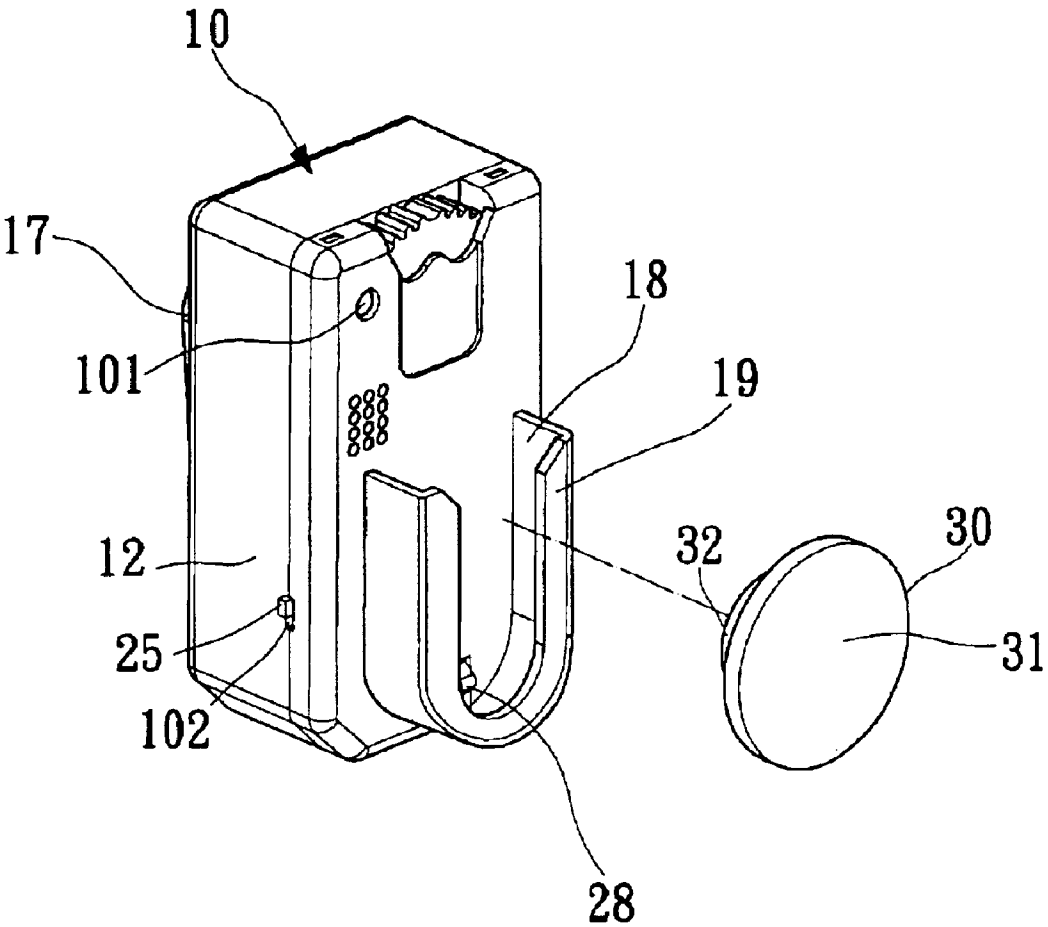
FIG. 17 is a perspective assembly view of an eighth embodiment of the present invention.
Figure 18:
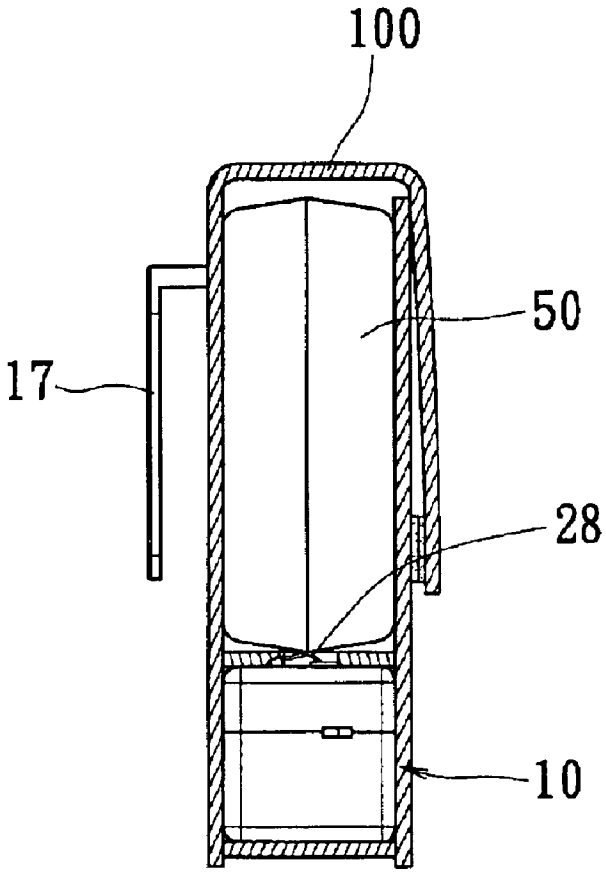
FIG. 18 is a perspective assembly view of a ninth embodiment of the present invention.
Figure 19:
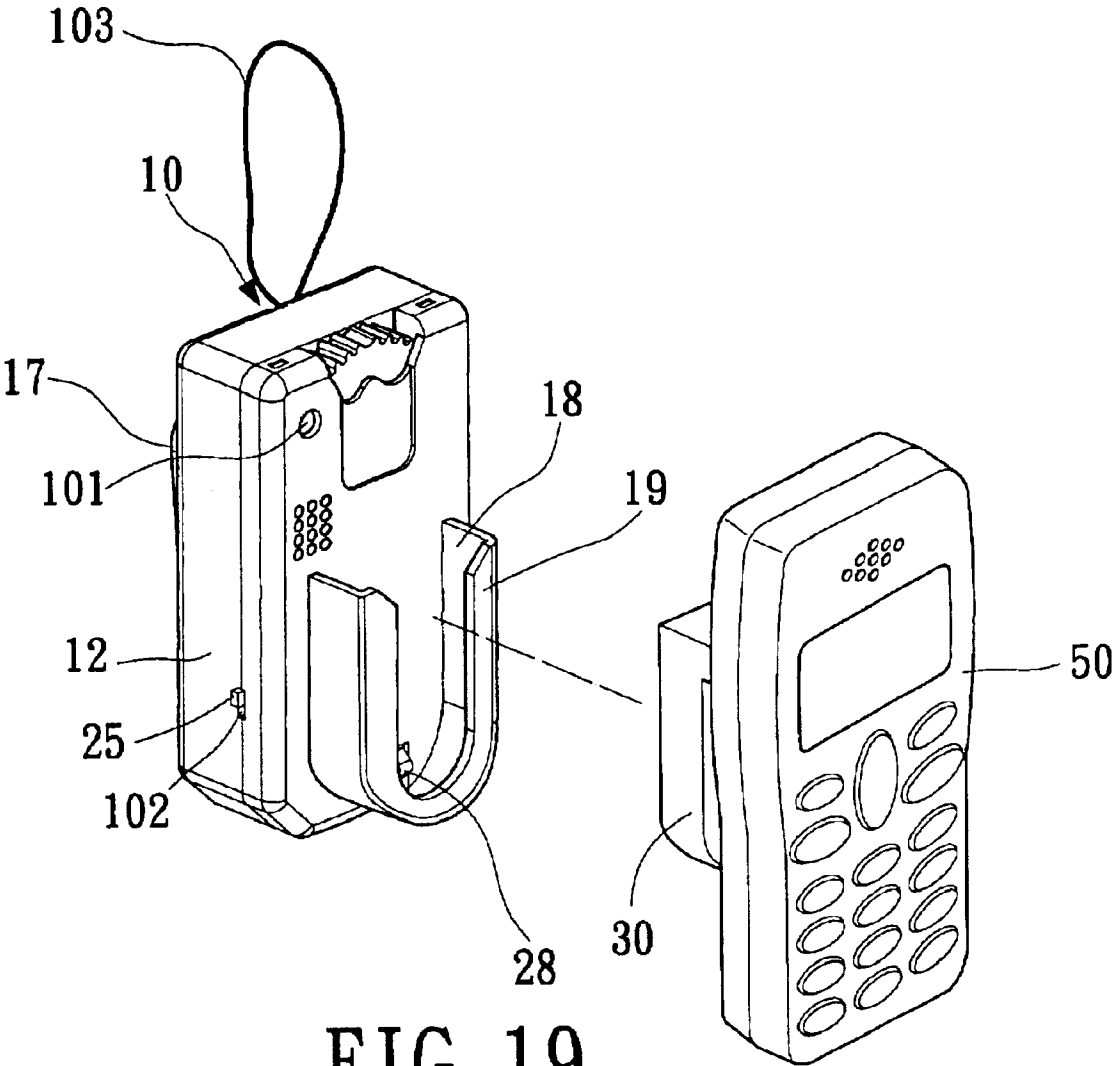
FIG. 19 is a perspective view showing a tenth embodiment of the present invention in use.

Furthermore, as shown in FIGS. 16, 17 and 18, the shape and structure of the clamping device of the present invention can be varied. With reference to FIG. 19, a hanging strip 103 can also be connected to the shell body 10 of the present invention for convenient hanging. The shape and structure of the connection component 30 can also be varied.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A power-saving clamping device having a loss-guard function and used to connect a portable electronic device, said clamping device comprising:

a shell body with a clamping sheet disposed on an outer wall thereof;

a circuit unit disposed in said shell body and capable of receiving signals emitted by an emission component, said circuit unit having an alarm component and a contact switch; and a connection component connected to said portable electronic device, said connection component being also connected to said shell body in detachable way, said emission component being disposed on said portable electronic device, said connection component touching said contact switch to turn off said circuit unit when connected to said shell body.

2. The power-saving clamping device having a loss-guard function as claimed in claim 1, wherein said shell body has a receiving space therein, and said circuit unit is disposed in said receiving space.

3. The power-saving clamping device having a loss-guard function as claimed in claim 2, wherein a battery is received in said receiving space of said shell body, said battery is connected to said circuit unit, and a battery cover corresponding to said battery is fastened on one side of said shell body.

4. The power-saving clamping device having a loss-guard function as claimed in claim 1, wherein said shell body is formed by assembling a first half shell and a second half shell together.

5. The power-saving clamping device having a loss-guard function as claimed in claim 1, wherein a fastening groove is disposed in a front side of said shell body, a baffle is extended from a front side of said fastening groove, said connection component has a fastening portion fastened with said fastening groove on the front side of said shell body in detachable way, and said contact switch is inserted into said fastening groove.

6. The power-saving clamping device having a loss-guard function as claimed in claim 1, wherein a wire-winding unit is disposed in said shell body, a signal cable is elastically wound in said wire-winding unit, and two ends of said signal cable are connected to a plug and an earphone, respectively.

7. The power-saving clamping device having a loss-guard function as claimed in claim 1, wherein a wire-winding unit is disposed in said shell body, a signal cable is elastically wound in said wire-winding unit, and two ends of said signal cable are connected to a plug and a hand-free headset, respectively.

8. The power-saving clamping device having a loss-guard function as claimed in claim 1, wherein said alarm component of said circuit unit is a light-emitting component, and a light-permeable hole corresponding to said light-emitting component is disposed on said shell body.

9. The power-saving clamping device having a loss-guard function as claimed in claim 1, wherein said alarm component of said circuit unit is a sound-emitting component.

10. The power-saving clamping device having a loss-guard function as claimed in claim 1, wherein said circuit unit has a switch, and a switch hole corresponding to said switch is disposed on said shell body.

11. The power-saving clamping device having a loss-guard function as claimed in claim 1, wherein said connection component has a connection portion, and said connection portion is connected to said portable electronic device.

12. The power-saving clamping device having a loss-guard function as claimed in claim 1, being disposed in a sheath body.

13. A power-saving clamping device having a loss-guard function and used to connect a portable electronic device, said clamping device comprising:

a shell body with a clamping sheet disposed on an outer wall of said shell body;

a circuit unit disposed in said shell body and capable of receiving signals emitted by an emission component, said circuit unit having an alarm component and a contact switch; and a connection component connected to said portable electronic device or connected to said portable electronic device in detachable way, said emission component being disposed on said connection component, and said connection component touching said contact switch to turn off said circuit unit when connected to said shell body.

* * * * *